US005595615A

United States Patent [19]

Shibata et al.

[11] Patent Number: 5,595,615

[45] Date of Patent: Jan. 21, 1997

[54] HIGH TOUGHNESS AND HIGH STRENGTH ALUMINUM ALLOY CASTING

[75] Inventors: Ryoichi Shibata, Tochigi-ken; Rikizou Watanabe, Mooka, both of Japan

[73] Assignee: Hitachi Metals, Ltd., Tokyo, Japan

[21] Appl. No.: 296,245

[22] Filed: Aug. 25, 1994

[30] Foreign Application Priority Data

Aug. 26, 1993 [JP] Japan ..... 5-234186

[51] Int. Cl.[6] ..... C22C 21/06

[52] U.S. Cl. ..... 148/440; 420/542; 420/544; 420/546; 420/547; 420/553

[58] Field of Search ..... 148/440; 420/542, 420/544, 546, 547, 553

[56] References Cited

U.S. PATENT DOCUMENTS 2,908,566 10/1959 Cron et al. ..... 420/544

*Primary Examiner*—David A. Simmons

*Assistant Examiner*—Robert R. Koehler

*Attorney, Agent, or Firm*—Antonelli, Terry, Stout & Kraus

[57] ABSTRACT

A high toughness and high strength casting of an aluminum alloy, has comparatively thick portions with a thickness of 20 mm or more, 4–6% Si, 0.2–0.6% Mg, less than 0.15% Fe, not more than 0.4% Mn, by weight, residual aluminum and unavoidable impurities; Si(%)×Mg(%) having a value of 1.2–2.8. In forming the casting, the aluminum alloy is under an atmosphere of more than atmospheric pressure during solidification and subsequently a T6 heat treatment is applied to casting.

8 Claims, 8 Drawing Sheets

HIGH TOUGHNESS AND HIGH STRENGTH ALUMINUM ALLOY CASTING

BACKGROUND OF THE INVENTION

1. Field of the Invention

The present invention relates to an aluminum alloy casting having partially thick portions and being used for members having excellent toughness and high tensile strength together with requiring high strength such as aluminum wheels or other casting parts for a suspension system of an automobile.

2. Description of the Related Art

As far as an aluminum casting used as strength-requiring member for an automobile or the like is concerned, both strength and safety are important, in addition, excellent mechanical properties such as soundness, toughness, in particular high elongation, high 0.2% yield strength, and high tensile strength are required.

As to an alloy having such mechanical properties, there is an AC4CH (JIS) alloy of Al—Si—Mg alloy system. The AC4CH alloy usually comprises about 7% Si, 0.3% Mg and 0.2% (usually 0.15%) Fe, and have an excellent castability. In particular, when a low temperature of molten metal(s) or alloy(s) is casted into a mold, or at portions casted at high cooling rate of the temperature, for example, at thin skin portions, resulting castings will have rather good mechanical properties. As a result, the AC4CH alloy has been used for castings such as aluminum wheel, cross member and knuckle housing as a suspension apparatus part for an automobile, each of said members or parts require both strength and toughness.

Automobile parts, such as aluminum wheel, cross member, steering knuckles or the like, contain complicated figure of parts therein. Therefore, castability thereof is ensured by increasing the temperature of metal mold for casting at least 200° C., preferably 300° C. or more. Such a high metal mold temperature is liable to cause casting defects as well as to produce coarse crystallized substance in thick portions thereof wherein cooling rate of the temperature is rather slow. FIG.13 shows an example of crystallized substance comprising coarsed crystallized grains at the grain boundary, wherein the grain components are selected from the group consisting of at least two kinds of elements of Al, Si, Fe and Mg. In FIG.14(A) through FIG.14(D) there are shown enlarged scale of various forms of crystallized substances. FIG.14(A) shows an acicular crystallized substance (Al—Si—Fe alloy system), FIG.14(B) a skeleton-like crystallized substance (Al—Si—Fe alloy system), FIG.14(C) an Al—Si—Mg—Fe alloy system of crystallized substance, and FIG.14(D) a feather-like crystallized substance (Al—Si—Ti alloy system.). In the case such crystallized substances are formed there are easily occurred casting defects such as shrinkage holes, pin holes and the like as well as decreased mechanical properties especially in elongation.

As mentioned above, in a portion having a thick section, such as thick portion of an aluminum alloy casting, its cooling rate is slow so as to obtain inferior mechanical properties.

It is intended in the present invention to provide an aluminum alloy casting comprising the problems to be solved in the prior art as mentioned above, less decreased chemical properties and excellent toughness even under the condition of less cooling rate at the thick portion thereof as an automobile part such as aluminum wheel, suspension apparatus part or the like.

SUMMARY OF THE INVENTION

After a diligent study aimed at overcoming the aforementioned problems, the present inventors have found that an aluminum alloy casting having a high reliability and a high toughness even at thick portions thereof can be obtained from Al—Si—Mg alloy system of aluminum alloy by keeping said aluminum alloy under an atmospher of more than atmospheric pressure in solidification process of said alloy, applying modification of eutectic Si, decreasing Fe content, selecting an optimum value of Si(%)×Mg(%) in said alloy system and subsequently applying T6 heat treatment to said casting.

That is, a first high toughness and high strength aluminum alloy casting according to the present invention comprising; comparatively thick portions with a thickness of at least 20 mm, 4–6% Si, 0.2–0.6% Mg, less than 0.15% Fe, not more than 0.4% Mn by weight, 1.2–2.8 Si(%)×Mg (%), residual aluminum, and impurities unavoidable, keeping under an atmospher of more than atmospheric pressure in solidification process of said alloy, and T6 heat treatment subsequently applied to the casting.

A second high toughness and high strength aluminum alloy casting according to the present invention, comprising; in addition to said first characteristics of the present invention, a value of mechanical strength index [3×tensile strength ($N/mm^2$)+40×elongation(%)] being at least 1100.

A third high toughness and high strength aluminum alloy casting according to the present invention, comprising in addition to said first and second characteristics, a secondary dendrite arm spacing (hereafter referred to as "DAS2") in a portion where cooling rate of the temperature is slow being not less than 30 μm.

A preferred embodiment of the present invention can be applied to some automobile parts, and is particularly suitably applicable for aluminum wheels, and a suspension apparatus member such as a cross member or a steering knuckles.

In the following, there are given specified reasons for each composition range and composition value in the present invention.

(1) Si (silicon): 4–6%

Si is an element of an alloy of the invention which determines the castability of the alloy. When Si content of the alloy is less than 4%, the castability is poor with considerable shrinkage cavities accompanied. And when Si content is more than 6%, intermetallic compounds containing mainly Al, Mg, Si, and Fe are crystallized in an eutectic portion to impair the toughness of resulting casting. Si content, therefore, is specified to be 4 to 6%.

(2) Mg (magnesium): 0.2–0.6%

Mg, by virtue of T6 heat treatment, is combined with Si to form $Mg_2Si$ to be dispersed in the matrix to produce effectively increased strength. If the content of Mg is less than 2.0%, such effect is little, and if the content thereof is not less than 0.6%, intermetallic compounds comprising mainly Al, Mg, Si, and Fe are crystallized in an eutectic portion to impair the toughness of the resulting casting. Mg content, therefore, is specified to be 0.2 to 0.6%.

(3) Fe (iron): less than 0.15%, preferably less than 0.07%

Fe is known as a factor imparing the toughness of resulting casting. A casting having portions wherein cooling rate of the temperature is slow will crystallize intermetallic compounds containing Al, Si, Mg, and Fe to impair the toughness of the resulting casting. Fe content, therefore, is specified to be less than 0.15%, preferably less than 0.07%.

(4) Mn (manganese): less than 0.4%

Mn is added to a compound containing Fe to permit said crystallized compound to have some slight roundness. If the content of Mn is not less than 0.4%, intermetallic compounds comprising Mn are crystallized to impair the toughness of the resulting casting. Mn content, therefore, is specified to be less than 0.4%.

(5) Si(%)×Mg(%): 1.2–2.8

In the present invention, Si and Mg have a relationship as shown in FIG. 1. When the value of Si(%) X Mg(%) is greater than 2.8, in an eutectic portion of the resulting casting there will be crystallized intermetallic compounds to impair the toughness of the casting. On the other hand, when the value of Si(%)×Mg(%) is less than 1.2, casting defects are liable to be caused or the strength of the matrix will be decreased. Si(%)×Mg(%) value, therefore, is specified to be 1.2–2.8.

(6) T6 Heat Treatment

This is a heat treatment, wherein keeping a casting, which has a comparatively thick portion with a thickness of at least 20 mm and comprises said chemical components, at a solid solution treatment temperature of 500°–550° C. for 2–8 hours, and then ageing or applying age hardening to the casting preferably at a temperature of 140°–180° C. for 4–15 hours by means of water cooling or hot water cooling.

(7) Strength Index [3×tensile strength ($N/mm^2$)+40×elongation(%)]: 1100 or more.

A strength-requiring part needs both mechanical properties of elongation and tensile strength. It is usually difficult, however, that both elongation and tensile strength are compatible with each other at their higher values. The present inventors have found that the sum of the product of (coefficient)×(tensile strength) and the product of (coefficient)×(elongation) of said part is over a specified value, even when an impact force is given to the part, both the toughness and strength thereof can be satisfactorily obtained. Then the formula has been defined as strength index. According to the present invention, strength index has been specified to have a formula of [3×tensile strength ($N/mm^2$)+40×elongation(%)] having a value of 1100 or more.

(8) DAS2 at a portion of a casting where its cooling rate is slow: 30 μm or more Even when a high toughness and high strength aluminum alloy casting according to the present invention has a DAS2 being 30 μm or more at a portion where its cooling rate is slow, its strength index has a value of at least 1100.

(9) Atmosphere pressure: more than atmospheric pressure

The preferior properties are obtained under the higher atmosphere pressure than atmospheric pressure. Considering both economy of an atmosphere press chamber and a pressure equipment and improvement of properties, generally, atmosphere pressure is specified to be 0.2–1.5 MPa.

In addition to said composition range and ingredients, $H_2$ (hydrogen) content is specified to be 0.4% or less, then it will be inhibited that the generation of blisters in the aluminum alloy casting at solid solution treatment together with the production of pin holes therein.

It is also recommended that less than 2.0% of Ti (titanium), and further less than B (boron), is added to the alloy to gain fine macro crystal grains.

For further improvement of the casting, the mechanical strength thereof is increased by spherically finely dividing the shape of Si in the eutectic matrix by the addition of small amounts of Na, Sr, Sb, and the like to the molten alloy.

DESCRIPTION OF THE PREFERRED EMBODIMENTS

In the following, the embodiments according to the present invention will be explained in detail.

(Embodiment 1)

Figure 12:
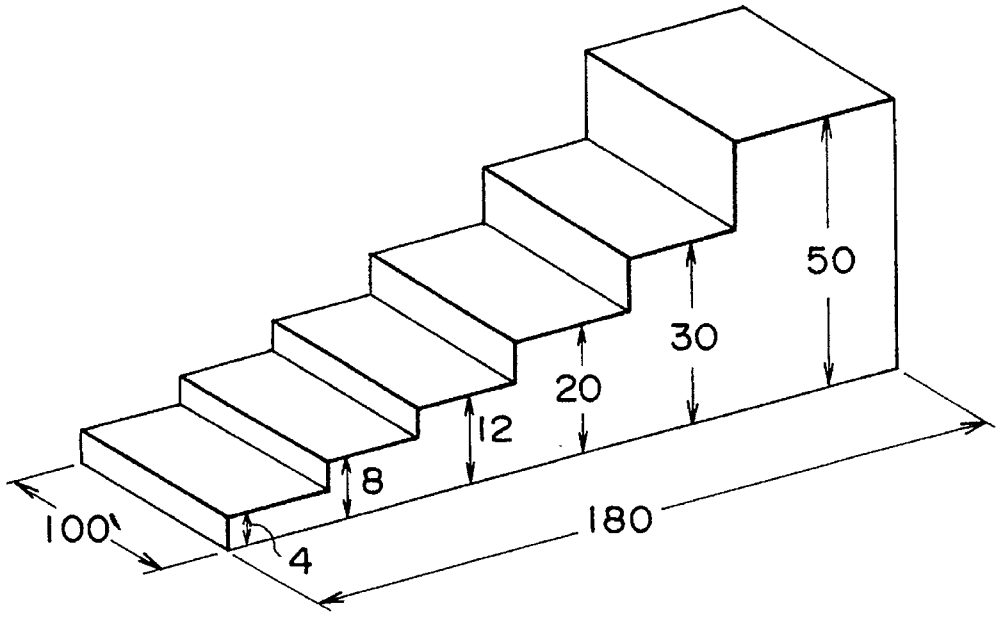
FIG. 12: A sketch showing a staircase shaped specimen.

After the preparation of molten alloys of chemical composition shown in table 1, refining and degassing were applied to the molten alloys to be poured into a mold to form a staircase shaped specimen as shown in FIG. 12 at atmospheric pressure or 1 MPa atmosphere.

TABLE 1

| number | chemical composition Si (%) | Mn (%) | Mg (%) | Fe (%) | Ti (%) | Sr (ppm) | H2 (ml/100 g) | Si × Mg | atmosphere pressure (MPa) |
|---|---|---|---|---|---|---|---|---|---|
| example 101 | 5.24 | 0.01 | 0.39 | 0.14 | 0.13 | 77 | 0.16 | 2.04 | 1 |
| comparative 501 | 7.12 | 0.01 | 0.31 | 0.13 | 0.17 | 67 | 0.12 | 2.21 | 1 |
| refference 502 | 5.24 | 0.01 | 0.39 | 0.14 | 0.13 | 77 | 0.16 | 2.04 | 0.1 |
| 503 | 7.12 | 0.01 | 0.31 | 0.13 | 0.17 | 67 | 0.12 | 2.21 | 0.1 |

After casting, evaluation test pieces were prepared from a staircase shaped specimen according to the each thickness of portion of the specimen. Each test piece was subjected to the measurement of mechanical characteristics, strength index, density of defect and DAS2. The test results are shown in Table 2.

TABLE 2

| number | thichness (mm) | elongation (%) | tensile strength ($N/mm^2$) | strength index | ratio of defect (%) | DAS2 (μm) |
|---|---|---|---|---|---|---|
| example 101 | 4 | 8.6 | 323 | 1313 | 0.02 | 25 |
| (high | 8 | 7.5 | 318 | 1254 | 0.02 | 28 |
| pressure) | 12 | 6.6 | 308 | 1188 | 0.02 | 37 |
| | 20 | 7.1 | 299 | 1181 | 0.02 | 44 |
| | 30 | 6.9 | 295 | 1161 | 0.03 | 48 |
| | 50 | 6.5 | 293 | 1139 | 0.03 | 50 |
| comparative 501 | 4 | 8.6 | 317 | 1275 | 0.01 | 21 |
| refference | 8 | 7.8 | 305 | 1227 | 0.01 | 26 |
| (high | 12 | 6.3 | 300 | 1152 | 0.04 | 34 |
| pressure) | 20 | 6.1 | 275 | 1069 | 0.03 | 41 |
| | 30 | 5.8 | 272 | 1048 | 0.03 | 43 |
| | 50 | 5.5 | 275 | 1045 | 0.03 | 48 |
| comparative 502 | 4 | 8.3 | 321 | 1295 | 0.07 | 25 |
| refference | 8 | 7.1 | 311 | 1217 | 0.09 | 29 |
| (atmospheric | 12 | 5.8 | 305 | 1147 | 0.14 | 38 |
| pressure) | 20 | 4.2 | 283 | 1017 | 0.29 | 43 |
| | 30 | 4.5 | 288 | 1044 | 0.32 | 47 |
| | 50 | 3.9 | 282 | 1002 | 0.34 | 52 |
| comparative 503 | 4 | 8.2 | 316 | 1276 | 0.05 | 20 |
| refference | 8 | 7.5 | 303 | 1209 | 0.08 | 27 |
| (atmospheric | 12 | 6.1 | 299 | 1141 | 0.11 | 35 |
| pressure) | 20 | 5.9 | 271 | 1049 | 0.21 | 41 |
| | 30 | 5.2 | 270 | 1018 | 0.24 | 45 |
| | 50 | 5.3 | 273 | 1031 | 0.31 | 51 |

According to Table 2, the tensile strength and the elongation as mechanical characteristics of Example 101, Comparative Refferences 501, 502 and 503 are excellent at a thinner thickness portion of 4 mm–12 mm, however, the thicker the thickness the poorer the mechanical characteristics.

However, as for Example 101, its test pieces have a thickness of 20 mm, 30 mm to 50 mm. And as for the elongation thereof, the thicker test pieces have the less decreased elongation, and the value of strength index [3×tensile strength ($N/mm^2$)+40×elongation(%)] is at least 1100; therefore, their overall mechanical strength can be considered to be preferable.

On the other hand, as for Comparative Refferences 501, 502, and 503 with the increase in the thickness of the test pieces, their corresponding elongations decrease, and the value of strength index at a thickness of 20 mm will become of 1100 or less; therefore, their overall mechanical strength can be considered to be insufficient.

Figure 7:
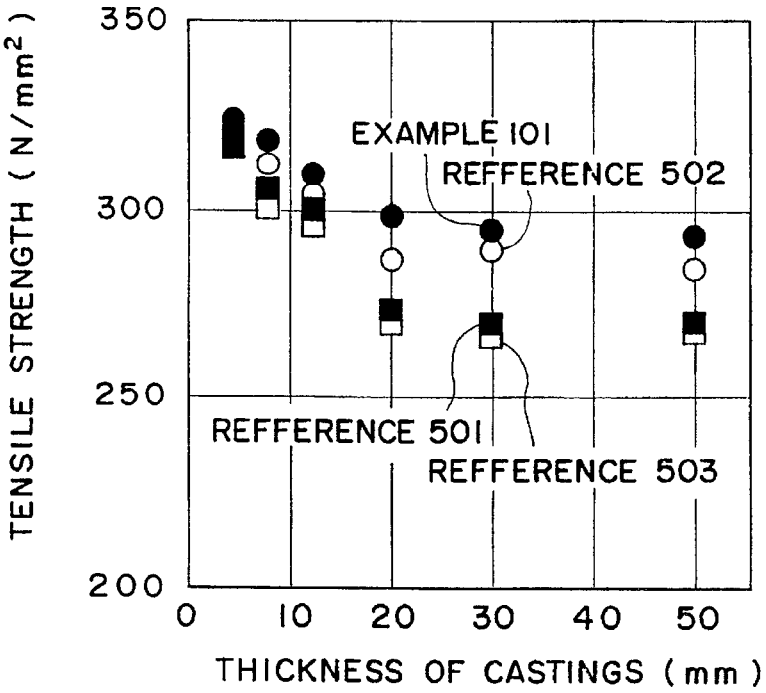
FIG. 7: A drawing showing the relationship between thickness and tensile strength in Examples and Comparative Refferences.
Figure 8:
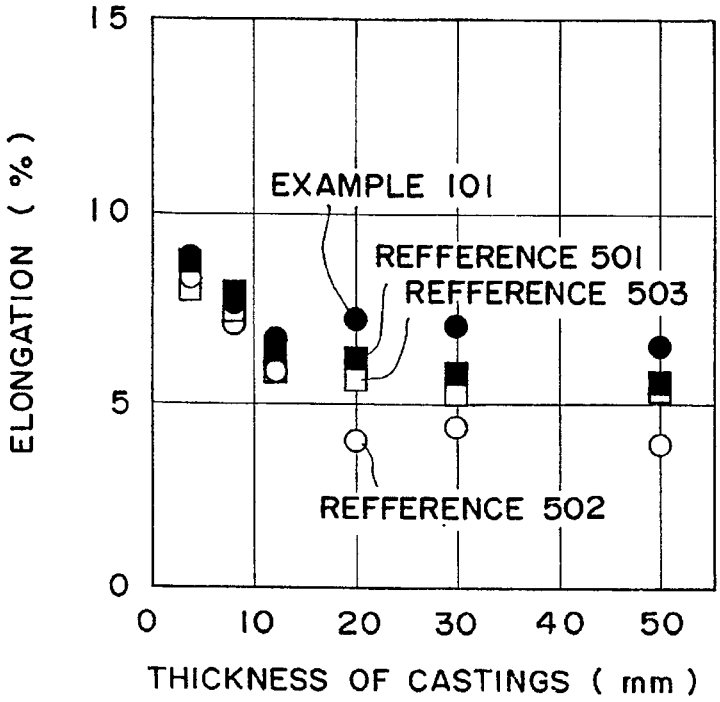
FIG. 8: A drawing showing the relationship between thickness and elongation in Examples and Comparative Refferences.
Figure 9:
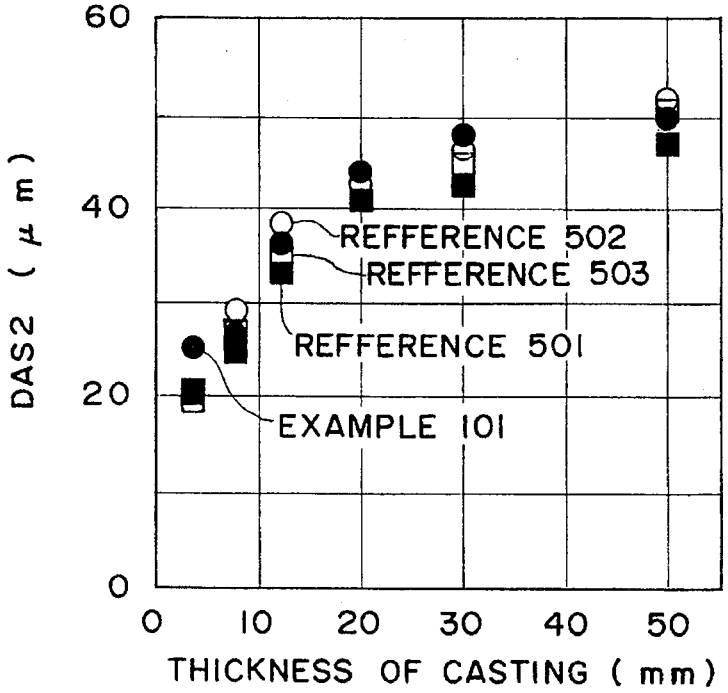
FIG. 9: A drawing showing the relationship between thickness and DAS2 in Examples and Comparative Refferences.
Figure 10:
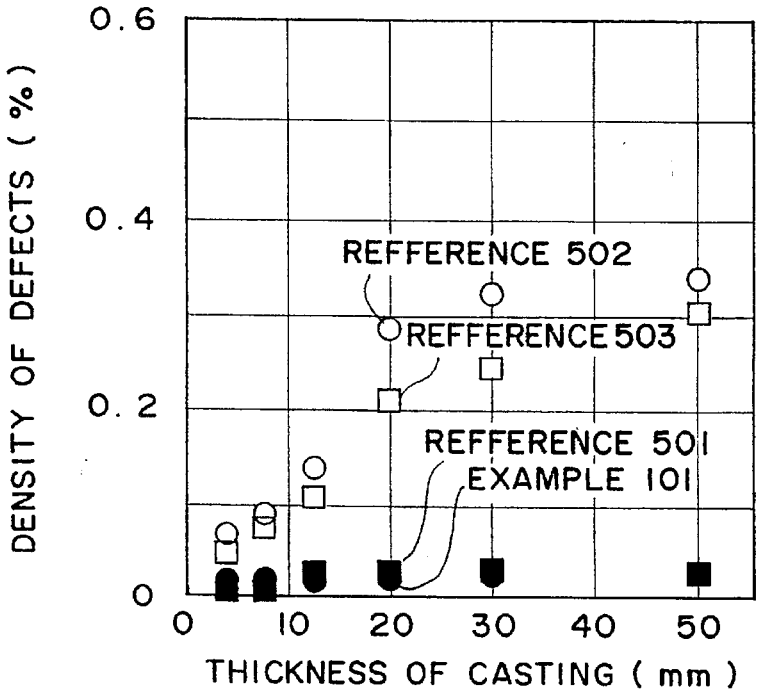
FIG. 10: A drawing showing the relationship between thickness and density of defect in Examples and Comparative Refferences.
Figure 11:
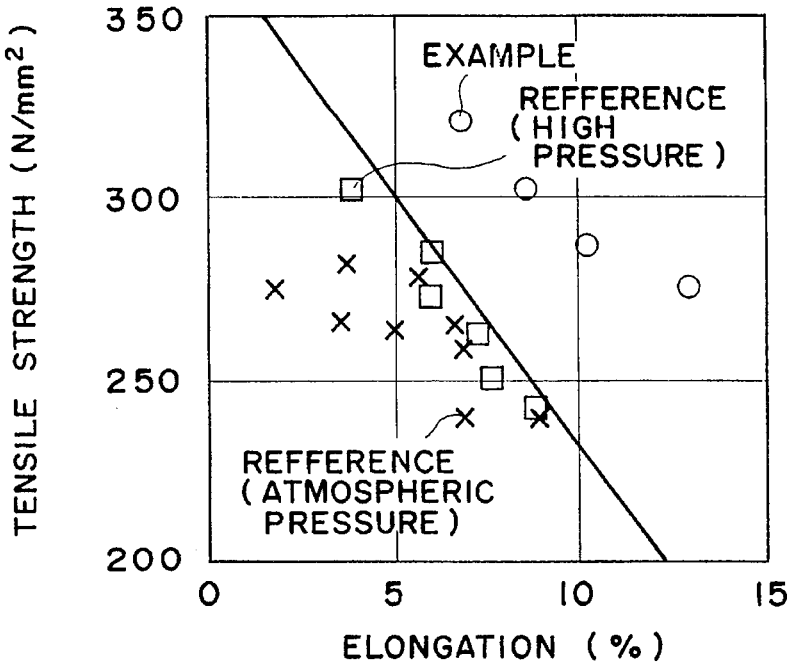
FIG. 11: Each of the drawings showing relationship between elongation and tensile strength in Examples and Comparative Refferences of Tables 3 to 4.

The results of Example 101 and 102 and Comparative Refferences 501, 502, and 503 in Table 2 are summarized into FIGS. 7 through 10. FIG. 7 shows the relationship between the thickness and the tensile strength of the casting, FIG. 8 shows the relationship between the thickness and the elongation of the casting, FIG. 9 shows the relationship between the thickness and the DAS2 of the casting, and FIG. 10 shows relationship between the thickness and the density of defect of the casting.

In FIG. 7, both in Example and Comparative Refferences, with the increase in the thickness of the casting the tensile strength thereof decreases to about 270$N/mm^2$. As shown in the relationship between the thickness and the elongation of the casting in FIG. 8, Examples have an elongation of 6% or more, that is, the decrease in elongation is little as compared with the increase in the thickness of the casting. On the other hand, as for Comparative Refferences with the increase in their thickness, the elongation thereof drops closely to 4%.

In the relationship between the thickness and the DAS2 of the casting shown in FIG. 9, with the increase in the thickness of the casting each DAS2 of Examples and Comparative Refferences increases in a comparable degree. In the relationship between the thickness and the density of defect of the casting shown in FIG. 10, each density of defect for Example 101 and Comparative Refference 501, both of which were casted under atmosphere of 1 MPa, is less than 0.1%, on the contrary, with the increase in the thickness of the casting, each density of defect increases similarly in Comparative Refferences 502 and 503, which are casted at atmospheric pressure.

Figure 13A:
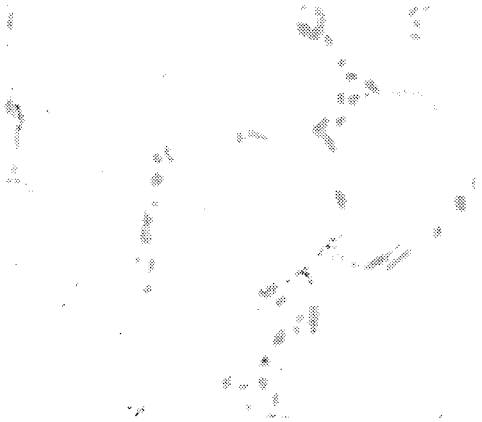
FIGS. 13A and 13B: Metallurgical texture photographs showing an eutectic portion of a casting with a thickness of 20 mm of (A) Example 101 and (B) Comparative Refference 501.
Figure 13B:
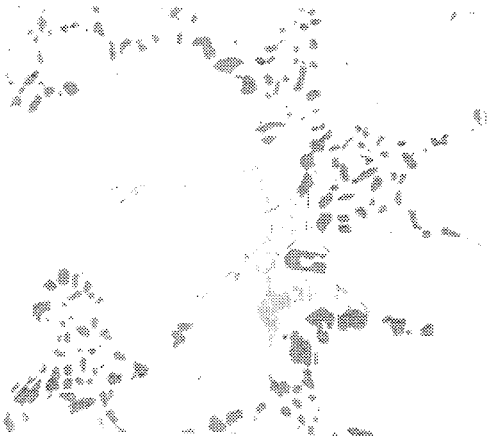
Figure 14A:
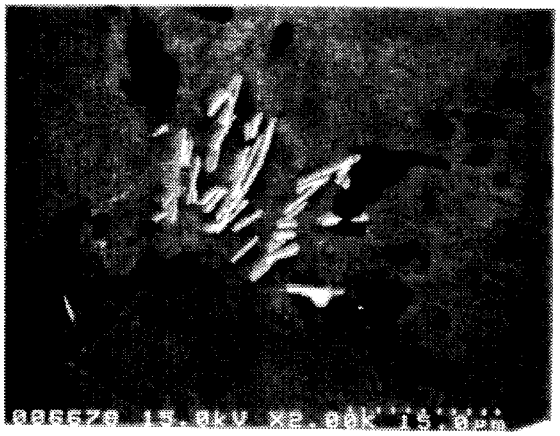
FIGS. 14A, 14B, 14C and 14D: Metallurgical texture photographs showing those of (A) acicular crystallized substance (Al—Si—Fe system), (B) skeleton-like crystallized substance (Al—Si—Fe system), (C) crystallized substance of Al—Si—Mg alloy system, and (D)feather-like crystallized substance (Ai—Si—Ti system).
Figure 14B:
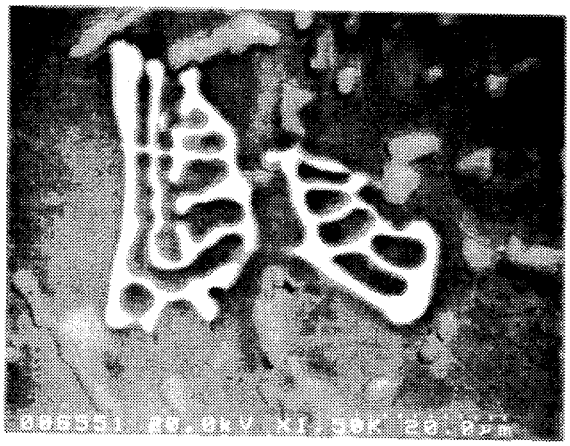
Figure 14C:
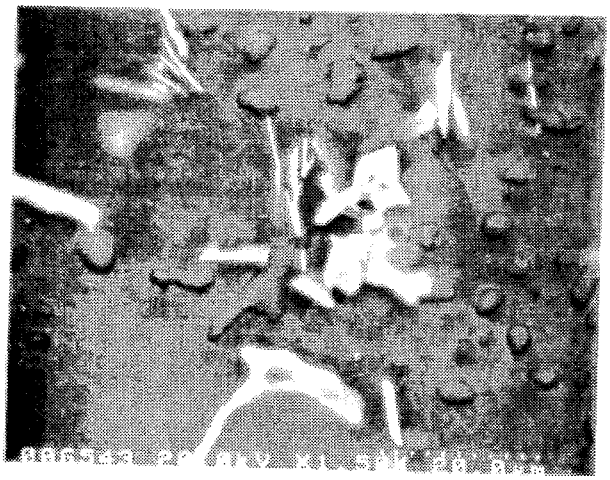
Figure 14D:
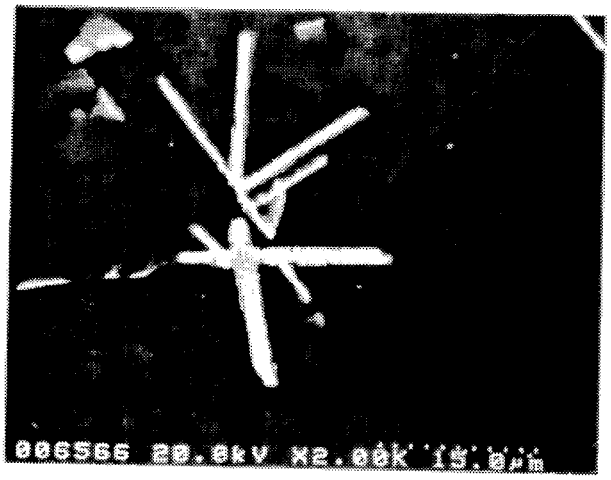

As far as the DAS2 is concerned, there is no significant difference between Example 101 and Comparative Refference 502 having the same chemical composition each other, however, Example 101 shows original good properties because of decrease of defect and is superior in an overall strength of "strength index" comprising tensile strength and elongation. On the other hand, in spite of decrease of defect, Comparative Refference 501 does not obtain significant improvement as compared with Example 101. This is because, as shown in FIG. 13, crystallized substances existing in an eutectic portion of (A) Example 101 have the figure and the dimension with which does not badly influence the toughness, on the contrary, in (B) Comparative Refference 501, a large crystallized substances of coarsed intermetallic compounds which are selected from the group consisting of at least two kinds of elements of Al, Si, Fe, and Mg exists at the grain boundary.

Figure 5A:
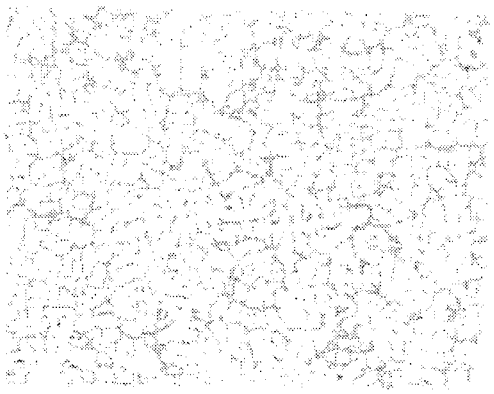
FIGS. 5A and 5B: Metallurgical texture photographs showing a portion of a casting with a thickness of 20 mm of (A) Example 101 and (B) Comparative Refference 502.
Figure 5B:
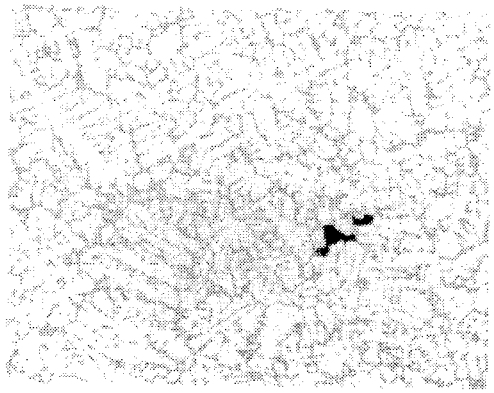
Figure 6A:
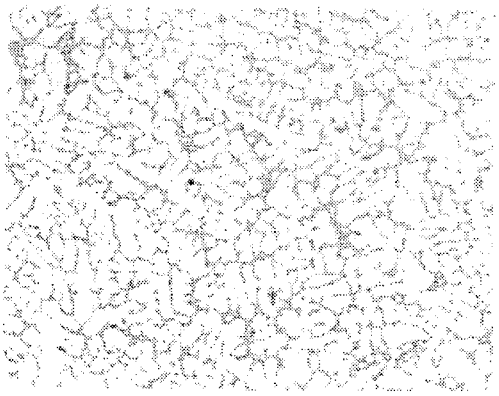
FIGS. 6A and 6B: Metallurgical texture photographs showing a portion of a casting with a thickness of 50 mm of (A) Example 101 and (B) Comparative Refference 502.
Figure 6B:
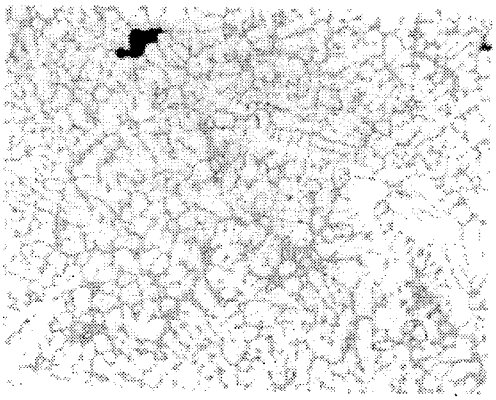

FIG. 5 is Metallurgical texture photographs showing a portion of a casting with a thickness of 20 mm in (A) Example 101 and (B) Comparative Refference 502, and in (A) Example 101, the density of defect and the DAS2 thereof are 0.03% and 442 μm, respectively, and in (B) Comparative Refference 502, the density of defect and DAS2 thereof are 0.29% and 43 μm, respectively. FIG. 6 is Metallurgical texture photographs showing a portion of a casting with a thickness of 50 mm in (A) Example 101 and (B) Comparative Refference 502, and in (A) Example 101, the density of defect and the DAS2 thereof are 0.03% and 50 μm, respectively, and in (B) Comparative Refference 502, the density of defect and the DAS2 thereof are 0.34% and 52 μm, respectively.

(Embodiment 2)

As in Embodiment 1, staircase shaped test pieces were prepared in a metal mold by means of casting. In Table 3, therein are given analytical results of the chemical composition and the atmosphere pressure in casting process in Examples 102 through 105 and Comparative Refference 508 through 519 using the specimen portions with a thickness of 20 mm.

TABLE 3

| | | chemical composition | | | | | | | | atmosphere |
|---|---|---|---|---|---|---|---|---|---|---|
| | number | Si (%) | Mn (%) | Mg (%) | Fe (%) | Ti (%) | Sr (ppm) | H2 (ml/100 g) | Si × Mg | pressure (MPa) |
| example | 102 | 4.23 | 0.01 | 0.29 | 0.14 | 0.14 | 81 | 0.17 | 1.22 | 1 |
| | 103 | 4.13 | 0.01 | 0.49 | 0.14 | 0.17 | 72 | 0.14 | 2.02 | 1 |
| | 104 | 5.05 | 0.01 | 0.21 | 0.14 | 0.15 | 65 | 0.12 | 1.06 | 1 |
| | 105 | 5.98 | 0.01 | 0.42 | 0.13 | 0.14 | 67 | 0.18 | 2.51 | 1 |
| comparative | 504 | 3.66 | 0.01 | 0.38 | 0.13 | 0.14 | 78 | 0.13 | 1.39 | 1 |
| refference | 505 | 3.72 | 0.01 | 0.65 | 0.13 | 0.14 | 82 | 0.16 | 2.42 | 1 |
| | 506 | 6.89 | 0.01 | 0.09 | 0.14 | 0.14 | 62 | 0.15 | 0.62 | 1 |
| | 507 | 7.15 | 0.01 | 0.41 | 0.13 | 0.16 | 72 | 0.15 | 2.93 | 1 |
| | 508 | 8.11 | 0.01 | 0.21 | 0.14 | 0.16 | 68 | 0.14 | 1.70 | 1 |
| | 509 | 8.87 | 0.01 | 0.11 | 0.14 | 0.15 | 65 | 0.12 | 0.97 | 1 |
| | 510 | 3.66 | 0.01 | 0.38 | 0.13 | 0.14 | 78 | 0.13 | 1.39 | 0.1 |
| | 511 | 3.72 | 0.01 | 0.65 | 0.13 | 0.14 | 82 | 0.16 | 2.42 | 0.1 |
| | 512 | 4.23 | 0.01 | 0.29 | 0.14 | 0.14 | 81 | 0.17 | 1.22 | 0.1 |
| | 513 | 4.13 | 0.01 | 0.49 | 0.14 | 0.17 | 72 | 0.14 | 2.02 | 0.1 |
| | 514 | 5.05 | 0.01 | 0.21 | 0.14 | 0.15 | 65 | 0.12 | 1.06 | 0.1 |
| | 515 | 5.98 | 0.01 | 0.29 | 0.13 | 0.14 | 67 | 0.18 | 1.76 | 0.1 |
| | 516 | 6.89 | 0.01 | 0.09 | 0.14 | 0.14 | 62 | 0.15 | 0.62 | 0.1 |
| | 517 | 7.15 | 0.01 | 0.41 | 0.13 | 0.16 | 72 | 0.15 | 2.93 | 0.1 |
| | 518 | 8.11 | 0.01 | 0.21 | 0.14 | 0.16 | 68 | 0.14 | 1.70 | 0.1 |
| | 519 | 8.87 | 0.01 | 0.11 | 0.14 | 0.15 | 65 | 0.12 | 0.97 | 0.1 |

In the following, evaluation test pieces were prepared in accordance with the same method as in Embodiment 1 to evaluate the mechanical properties, the strength index, the density of defect and the DAS2 thereof. The results are shown in Table 4.

TABLE 4

| number | elongation (%) | tensile strength ($N/mm^2$) | strength index | ratio of defect (%) | DAS2 (μm) |
|---|---|---|---|---|---|
| example 102 | 10.2 | 283 | 1257 | 0.04 | 47 |
| (high 103 | 6.8 | 321 | 1235 | 0.05 | 43 |
| pressure) 104 | 13.1 | 275 | 1349 | 0.03 | 38 |
| 105 | 8.5 | 301 | 1243 | 0.05 | 40 |
| comparative 504 | 6.0 | 280 | 1080 | 0.08 | 52 |
| refference 505 | 3.9 | 302 | 1062 | 0.10 | 49 |
| (high 506 | 8.7 | 241 | 1071 | 0.01 | 40 |
| pressure) 507 | 5.7 | 273 | 1047 | 0.02 | 44 |
| 508 | 7.2 | 261 | 1071 | 0.01 | 42 |
| 509 | 7.5 | 250 | 1050 | 0.02 | 40 |
| comparative 510 | 3.6 | 270 | 954 | 0.52 | 49 |
| refference 511 | 1.6 | 275 | 889 | 0.55 | 51 |
| (atmospheric 512 | 7.3 | 265 | 1087 | 0.51 | 46 |
| pressure) 513 | 3.9 | 281 | 999 | 0.44 | 41 |
| 514 | 6.9 | 263 | 1065 | 0.23 | 39 |
| 515 | 4.9 | 261 | 979 | 0.21 | 40 |
| 516 | 8.5 | 239 | 1057 | 0.22 | 41 |
| 517 | 5.6 | 275 | 1049 | 0.24 | 46 |
| 518 | 6.9 | 257 | 1047 | 0.21 | 43 |
| 519 | 7.0 | 242 | 1006 | 0.22 | 41 |

Both of Example and Comparative Refferences which were casted in atmosphere of 1 MPa have the lower density of defect of 0.1% or less. In Example, the degree of the increase in the mechanical properties thereof is greater than the specimen casted at atmospheric pressure, and the strength index thereof is more than 1100. The strength index of the specimen casted at atmospheric pressure, however, is low.

(Embodiment 3)

Figure 1:
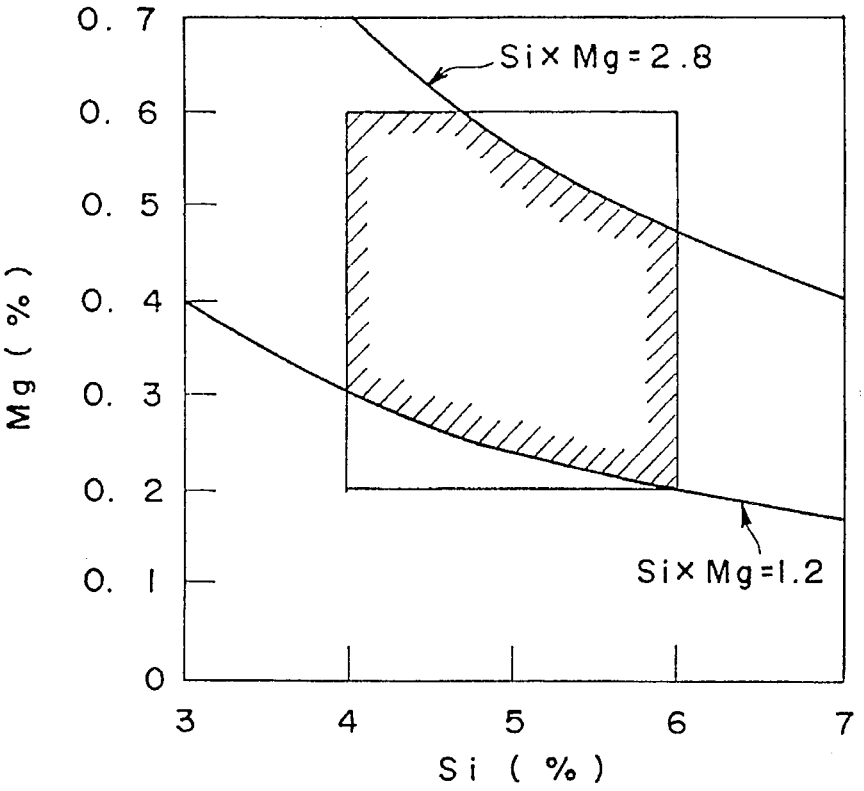
FIG. 1: A drawing showing a content range of Si and Mg in the present invention, and the relationship between Si and Mg.
Figure 2A:
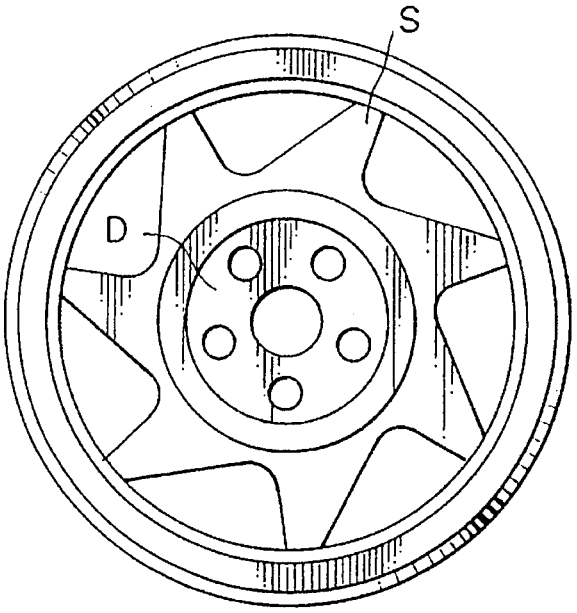
FIG. 2: A side view and a front view showing an aluminum wheel of an embodiment.
Figure 2B:
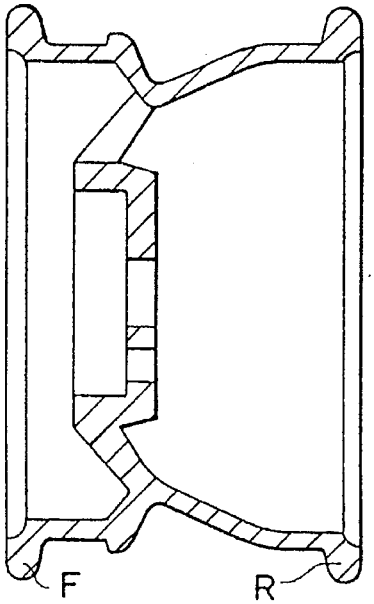

An aluminum wheel with a partial portion(s) having a thickness of 20 mm as shown in FIG. 2 was prepared by means of a low pressure die casting and a counter pressure die casting keeping the die part in 1 MPa atmosphere, respectively. The chemical compositions thereof are as shown in Table 5. The chemical composition of Example 106 is within the scope of the present invention. On the contrary, in Conparative Refference 520, the chemical composition thereof is out of the range according to the present invention, but the atmosphere thereof is high pressure. On the other hand, the chemical composition of Comparative Refference 521 and 522 is within the rage according to the present invention, but they are casted at atmospheric pressure by means of lower pressure die casting.

TABLE 5

| number | chemical composition | | | | | | | | atmosphere |
|---|---|---|---|---|---|---|---|---|---|
| | Si (%) | Mn (%) | Mg (%) | Fe (%) | Ti (%) | Sr (ppm) | H2 (ml/100 g) | Si × Mg | pressure (MPa) |
| example 106 | 5.57 | 0.01 | 0.40 | 0.14 | 0.14 | 82 | 0.14 | 2.23 | 1 |
| comparative 520 | 7.05 | 0.01 | 0.36 | 0.13 | 0.17 | 72 | 0.15 | 2.53 | 1 |
| refference 521 | 5.57 | 0.01 | 0.40 | 0.14 | 0.14 | 82 | 0.14 | 2.23 | 0.1 |
| 522 | 7.0 | 0.01 | 0.36 | 0.13 | 0.17 | 72 | 0.15 | 2.53 | 0.1 |

Next, after making an aluminum wheel by casting, test pieces were prepared by cutting said cover into the following specimens, namely a spoke portion (shown by abbreviation "S") with a casting thickness of 25 mm, a disk portion (shown by abbreviation "D") with a casting thickness of 25 mm, a front flange portion (shown by abbreviation "F") with a casting thickness of 10 mm, and a rear flange portion (shown by abbreviation "R") with a casting thickness of 10 mm to evaluate the elongation, tensile strength, degree of defect, DAS2 thereof. The results are given in Table 6.

TABLE 6

| | portion | thickness (mm) | elongation (%) | tensile strength ($N/mm^2$) | strength index | ratio of defect (%) | DAS2 (μm) |
|---|---|---|---|---|---|---|---|
| example 106 | S | 25 | 7.3 | 282 | 1138 | 0.14 | 48 |
| | D | 25 | 7.6 | 285 | 1159 | 0.10 | 53 |
| | R | 10 | 10.5 | 302 | 1326 | 0.08 | 22 |
| | F | 10 | 9.8 | 295 | 1277 | 0.09 | 20 |
| comparative 520 | S | 25 | 5.0 | 263 | 1029 | 0.11 | 45 |
| refference | D | 25 | 5.8 | 260 | 1012 | 0.09 | 50 |
| | R | 10 | 8.0 | 278 | 1154 | 0.07 | 22 |
| | F | 10 | 9.1 | 282 | 1210 | 0.09 | 23 |
| comparative 521 | S | 25 | 3.8 | 259 | 929 | 0.62 | 46 |
| refference | D | 25 | 5.2 | 263 | 997 | 0.59 | 52 |
| | R | 10 | 7.5 | 283 | 1149 | 0.31 | 23 |
| | F | 10 | 6.3 | 275 | 1077 | 0.28 | 20 |
| comparative 522 | S | 25 | 5.1 | 256 | 972 | 0.31 | 46 |
| refference | D | 25 | 4.8 | 251 | 945 | 0.24 | 53 |
| | R | 10 | 7.9 | 281 | 1159 | 0.24 | 23 |
| | F | 10 | 8.9 | 286 | 1214 | 0.26 | 22 |

In Example 106 of Table 6, even both the spoke portion (S) with a thickness of 25 mm and the design portion (D) with a thickness of 25 mm have a density of defect of 0.1% or more together with a DAS2 of 30 μm, strength index thereof is at least 1100. As for Example 106, even a thick portion has a sufficient strength. Therefore, said aluminum wheel is safe as a strength-requiring part for an automobile, and is available for the light-weighting of an automobile. On the contrary, in Comparative Refference 520 through 522, both the spoke portion (S) with a thickness of 25 mm and the design portion (D) with a thickness of 25 mm have a strength index of 1100 or less. As far as strength is concerned, the Comparative Refference is inferior to the Example.

(Embodiment 4)

Figure 3:
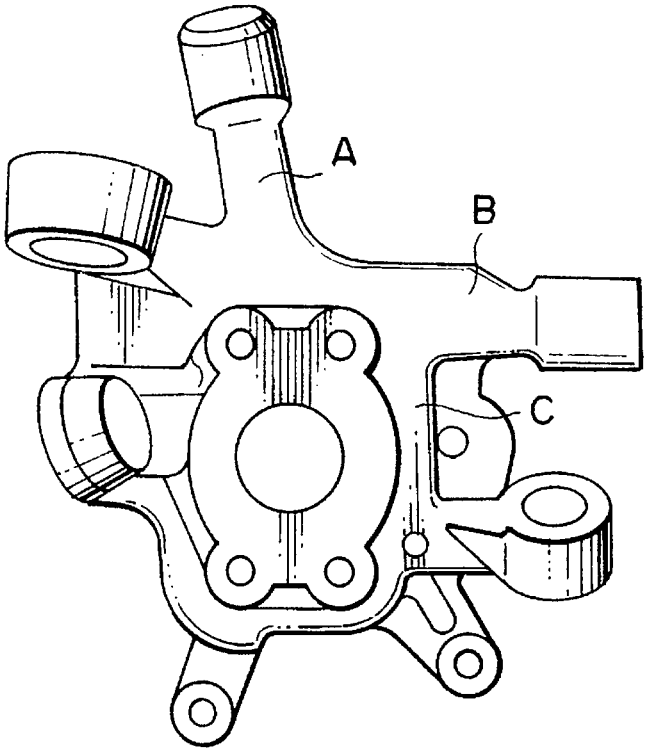
FIG. 3: A front view showing a steering knuckle flange of an embodiment.
Figure 4:
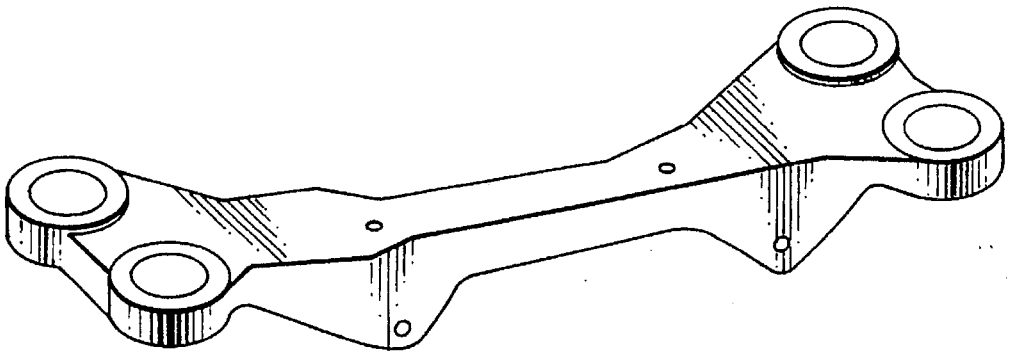
FIG. 4: A perspective view showing a cross member of an embodiment.

A rear housing of a suspension part having a partial thickness of at least 20 mm shown in FIG. 3 was casted by the same way as Embodiment 2. The chemical compositions thereof are as shown in Table 7. Casting were separately conducted according to the chemical composition of Example 107 being within the scope of the present invention and the chemical composition of Comparative Refference 523 being out of the scope of the present invention. After the preparation of a suspension by casting, portions of A, B and C having a casting thickness of 25 mm each were cut out from the suspension to obtain test pieces for the measurement of the elongation, tensile strength, strength index, density of defect and DAS2 thereof. The results obtained are shown in Table 8.

TABLE 7

| | chemical composition | | | | | | | | atmosphere |
|---|---|---|---|---|---|---|---|---|---|
| number | Si (%) | Mn (%) | Mg (%) | Fe (%) | Ti (%) | Sr (ppm) | H2 (ml/100 g) | Si × Mg | pressure (MPa) |
| example 107 | 5.08 | 0.01 | 0.43 | 0.04 | 0.16 | 75 | 0.14 | 2.18 | 1 |
| comparative 523 | 6.98 | 0.01 | 0.35 | 0.14 | 0.15 | 77 | 0.12 | 2.44 | 1 |
| refference 524 | 5.08 | 0.01 | 0.43 | 0.04 | 0.16 | 75 | 0.14 | 2.18 | 0.1 |
| 525 | 6.98 | 0.01 | 0.35 | 0.14 | 0.15 | 77 | 0.12 | 2.44 | 0.1 |

TABLE 8

| number | portion | thickness (mm) | results of evaluation test: elongation (%) | tensile strength ($N/mm^2$) | strength index | ratio of defect (%) | DAS2 (μm) |
|---|---|---|---|---|---|---|---|
| example 107 | A | 25 | 7.8 | 288 | 1176 | 0.09 | 48 |
| | B | 25 | 9.5 | 302 | 1286 | 0.08 | 51 |
| | C | 25 | 7.6 | 290 | 1174 | 0.09 | 50 |
| comparative 523 | A | 25 | 6.1 | 270 | 1054 | 0.06 | 45 |
| refference | B | 25 | 6.3 | 273 | 1071 | 0.08 | 48 |
| | C | 25 | 5.9 | 268 | 1040 | 0.09 | 50 |
| 524 | A | 25 | 4.6 | 271 | 997 | 0.52 | 48 |
| | B | 25 | 5.2 | 277 | 1039 | 0.51 | 50 |
| | C | 25 | 5.6 | 278 | 1058 | 0.52 | 49 |
| 525 | A | 25 | 5.3 | 268 | 1016 | 0.48 | 50 |
| | B | 25 | 4.9 | 275 | 1021 | 0.52 | 47 |
| | C | 25 | 5.6 | 266 | 1022 | 0.46 | 51 |

It is shown In Table 8 that as for Example 112, each of A, B and C portions have a strength index of 1100 or more, and even a thick portion can have sufficient strength. Therefore, said aluminum wheel is safe as a strength-requiring part for an automobile, as well as available for the light-weighting of an automobile.

On the contrary, in Comparative Refference 523 through 525, each of the portions A, B and C with a thickness of 25 mm has a strength index of 1100 or less. As far as strength is concerned, the Comparative Refference is inferior to the Example.

When the present invention is applied to a cross member of an automobile, said cross member having a partial thickness of 20 mm or more has enough strength: therefore, the member will be safe as a strength-requiring part for an automobile, and available for the light-weighting of an automobile.

[Effects of the Invention]

As substantially described above, a high toughness and high strength aluminum alloy casting, comprising comparatively thick portions having a thickness of 20 mm or more; 4–6% Si, 0.2–0.6% Mg, less than 0.15% Fe, not more than 0.4% Mn by weight, residual aluminum and unavoidable impurities; and Si(%)×Mg(%) having a value of 1.2–2.8. Said aluminum alloy is casted under an atmosphere of more than atmospheric pressure in its solidification process. And said aluminum alloy casting having been subjected to T6 heat treatment has a high value of strength index comprising tensile strength and elongation integrated, and therefore, the alloy is optimum for automobile parts necessitating toughness in particular such as aluminum wheel, steering knuckle housing, cross member or the like.

What is claimed is:

1. A high toughness and high strength casting of an aluminum alloy, said casting having comparatively thick portions with a thickness of 20 mm or more and said aluminum alloy comprising 4–5.98% Si, 0.2–0.6% Mg, less than 0.15% Fe, not more than 0.4% Mn, by weight, residual aluminum and unavoidable impurities, Si(%)×Mg(%) having a value of 1.2–2.8; said aluminum alloy being kept under an atmosphere of more than atmospheric pressure in solidification of said aluminum alloy to form said casting; and T6 heat treatment being applied subsequently to said casting.

2. A high toughness and high strength casting of an aluminum alloy, said casting having comparatively thick portions with a thickness of 20 mm or more and said aluminum alloy comprising 4–5.98% Si, 0.2–0.6% Mg, less than 0.15% Fe, not more than 0.4% Mn, by weight, residual aluminum and unavoidable impurities, Si(%)×Mg(%) having a value of 1.2–2.8; said aluminum alloy being kept under an atmosphere of more than atmospheric pressure in solidification of said aluminum alloy to form said casting; T6 heat treatment being applied subsequently to said casting; and a secondary dendrite arm spacing of 30 μm or more being exhibited at a portion of the casting with a slow cooling rate.

3. A high toughness and high strength casting of an aluminum alloy, said casting having comparatively thick portions with a thickness of 20 mm or more and said aluminum alloy comprising 4–5.98% Si, 0.2–0.6% Mg, less than 0.15% Fe, not more than 0.4% Mn, by weight, residual aluminum and unavoidable impurities, Si(%)×Mg(%) having a value of 1.2–2.8; said aluminum alloy being kept under an atmosphere of more than atmospheric pressure in solidification of said aluminum alloy to form said casting; T6 heat treatment being applied subsequently to said casting; and said thick portions having a mechanical characteristic strength index defined by 3×tensile strength ($N/mm^2$)+40× elongation(%) of 1100 or more.

4. A high toughness and high strength casting of an aluminum alloy as claimed in any one of claims 1, 2 or 3, wherein said aluminum alloy casting is an automobile part.

5. A high toughness and highness strength casting of an aluminum alloy as claimed in any one of claims 1, 2 or 3, wherein said aluminum alloy casting is an aluminum wheel for an automobile.

6. A high toughness and high strength casting of an aluminum alloy as claimed in any one of claims 1, 2 or 3, wherein said aluminum alloy casting is a suspension apparatus part for an automobile.

7. A high toughness and high strength casting of an aluminum alloy as claimed in any one of claims 1, 2 or 3, wherein said aluminum alloy consists essentially of 4–5.98% Si, 0.2–0.6% Mg, less than 0.15% Fe, not more than 0.4% Mn, no more than 0.4% $H_2$, less than 2.0% of Ti, by weight, no more than 82 ppm of Na, Sr or Sb, residual aluminum and unavoidable impurities.

8. A high toughness and high strength casting of an aluminum alloy as claimed in any one of claims 1, 2 or 3, wherein the pressure of the atmosphere of more than atmospheric pressure is 0.2–1.5 MPa.

* * * * *